US006160522A

United States Patent [19]

Sanford

[11] Patent Number: 6,160,522

[45] Date of Patent: Dec. 12, 2000

[54] CAVITY-BACKED SLOT ANTENNA

[75] Inventor: Gary S. Sanford, Apex, N.C.

[73] Assignee: L3 Communications Corporation, Randtron Antenna Systems Division, Menlo Park, Calif.

[21] Appl. No.: 09/054,336

[22] Filed: Apr. 2, 1998

[51] Int. Cl.[7] ..... H01Q 13/12

[52] U.S. Cl. ..... 343/769; 343/767; 343/789; 343/700 MS

[58] Field of Search ..... 343/700 MS, 767, 343/769, 770, 789

[56] References Cited

U.S. PATENT DOCUMENTS

| | | | |
|---|---|---|---|
| 2,508,085 | 5/1950 | Alford | 343/769 |
| 3,573,834 | 4/1971 | McCabe | 343/769 |
| 4,733,245 | 3/1988 | Mussler | 343/769 |
| 4,958,165 | 9/1990 | Axford et al. | 343/770 |
| 5,424,693 | 6/1995 | Lin | 333/33 |
| 5,465,100 | 11/1995 | Remondiere et al. | 343/769 |
| 5,646,637 | 7/1997 | Miller | 343/713 |
| 5,714,961 | 2/1998 | Kot et al. | 343/769 |
| 5,905,471 | 5/1999 | Biebl et al. | 343/769 |

OTHER PUBLICATIONS

Richard C. Johnson, *Antenna Engineering Handbook, Third Edition,* New York, McGraw–Hill, Inc., 1993, Chapter 7, pp. 7.1–7.29.

*Primary Examiner*—Tan Ho

*Attorney, Agent, or Firm*—Flehr Hohbach Test Albritton & Herbert LLP

[57] ABSTRACT

A cavity backed slot antenna comprises a conductive cavity, a conductive film carried by a thin dielectric substrate which is above the cavity. The conductive film includes one or more slots which an electric field is applied to radiate an electromagnetic energy.

17 Claims, 8 Drawing Sheets

CAVITY-BACKED SLOT ANTENNA

BRIEF DESCRIPTION

This invention relates generally to a cavity-backed slot antenna and more particularly to a slot antenna having low back-scatter.

BACKGROUND OF THE INVENTION

In the design of aircraft and other vehicles with low radar cross section, the back-scatter from antennas is an important issue. Often the problem is to design antennas that function efficiently over a relatively narrow bandwidth but suppress the back-scatter at frequencies outside this band. At first glance the microstrip patch antenna appears to be an ideal candidate for solving this kind of problem. It is typically thin, making it easy to suppress structural scattering. More importantly, it has a narrow operating bandwidth with an impedance that tends toward a short circuit outside of this band. The problem is that the patch, like other transmission line components, does not resonate at a single frequency. A second resonance typically occurs somewhere between the second and third harmonic, and other resonances follow. At these higher frequencies, antenna back-scatter tends to be large and generally unacceptable.

One solution to this problem is to recess a patch or cavity-backed slot antenna slightly below the surrounding surface. The resulting cavity is filled with a layer of closed cell foam, or some other material with a very low dielectric constant, and then a layer of magnetic radar absorbing material (RAM) is placed on top of the foam. The RAM is brought flush with the surrounding surface, and its edges are usually tapered to provide a gradual transition to the surrounding metallic surface. In the operating band of the antenna the RAM is designed to be somewhat transparent with resulting losses usually not exceeding two or three dB. At higher frequencies the RAM is designed to be much more absorptive so that the antenna, and its back-scatter at higher order resonances, are hidden by the RAM cover material. The use of RAM for back-scatter suppression makes the design relatively large, complex and costly. It is very difficult to obtain a sufficiently sharp frequency cut-off in the RPM to avoid compromising either the radiation efficiency or the back-scatter suppression.

Another approach to the problem is to actually suppress the higher order resonances within the structure of the antenna. a recessed circular patch antenna which suppresses the higher order modes is shown in FIGS. 1 and 2. The antenna includes a high dielectric alumina substrate 11 having a conductive film or layer 12, such as copper, on one surface. The conductive film is etched to form a slot 13. The dielectric substrate 11 is placed in a cavity 14 formed in the support structure 16. The ground plane formed by the recessed supporting structure is electrically connected to the film 17 surrounding the circular patch 18. a coaxial connector 19 is attached to the ground plane with the center conductor 21 extending to the patch 18 and connected to the patch. The position of the connection determines the impedance presented by the antenna. The electric fields across the gap 13 radiate in an omnidirectional pattern into the half space above the ground plane.

The resulting resonance of the patch is determined not simply by the dimensions of the patch but also by the capacitive loading along the edges of the patch. The capacitance of the narrow slot tends to act as a lumped capacitance so that its susceptance monotonically approaches infinity as frequency increases. While this susceptance works well in combination with the susceptance of the patch to form the primary resonance, the larger values of susceptance at higher frequencies tend to short out the higher order resonances. The suppression of higher order resonances by capacitively loading slot edges is smaller, less complex, less costly and more effective than using RAM. However, this approach has required the use of a material with a high dielectric constant to achieve the required value of capacitance. Ceramics such as alumina are suitable for this purpose and are good dielectrics. Typical gap widths on alumina are 0.005 to 0.010 inch, which are quite reasonable. Nevertheless, ceramics are difficult to work with in development, and their dielectric constant varies significantly from lot to lot. Soft substrates with ceramic loading can also be used for this application, but the control of the dielectric constant is even more of a problem. Both materials tend to be relatively costly. What is needed is a way to suppress the higher frequency resonances without using special materials.

OBJECTS AND SUMMARY OF THE INVENTION

It is a general object of the present invention to provide a patch antenna which suppresses higher frequency resonances using inexpensive materials.

It is another object of the present invention to provide a patch antenna having increased capacitance per unit length at least along the radiating portion of the slot.

It is another object of the present invention to provide a patch antenna having a meander slot to provide increased capacitance.

The foregoing and other objects of the invention are achieved by a patch antenna in which the capacitance per unit length of the radiating portion of the patch is increased by increasing the area of the capacitance per unit length.

DESCRIPTION OF PREFERRED EMBODIMENTS

Figure 1:
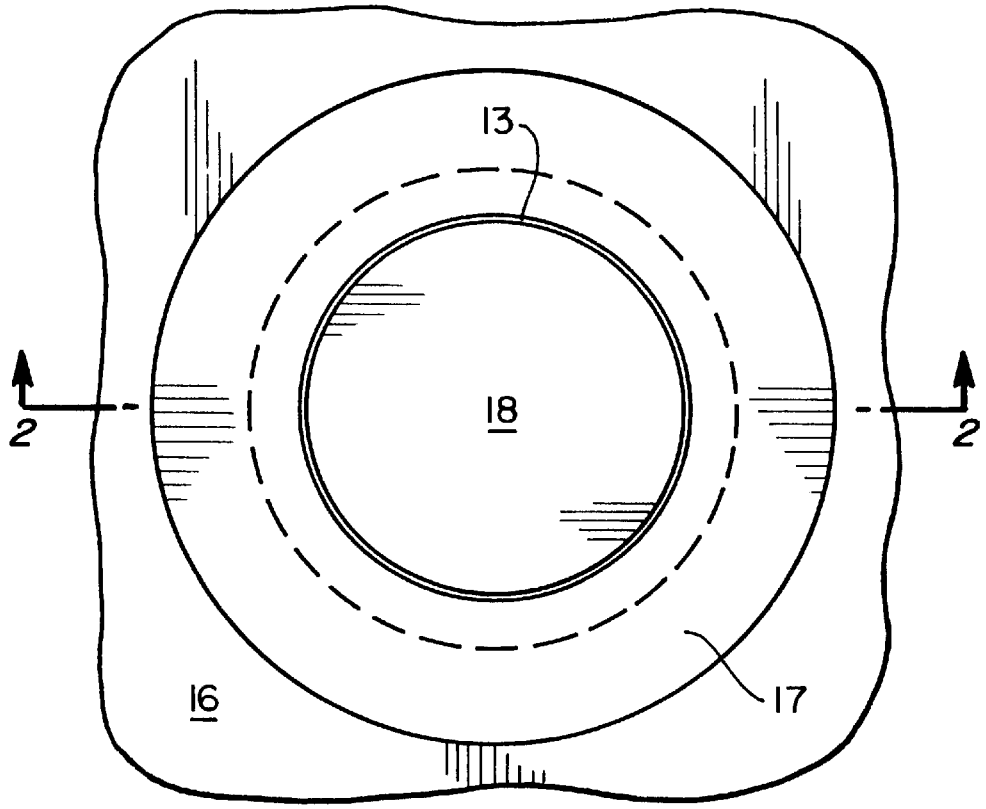
FIG 1 (PRIOR ART)
FIG. 1 is a plan view of a slot antenna in accordance with the prior art.
Figure 2:
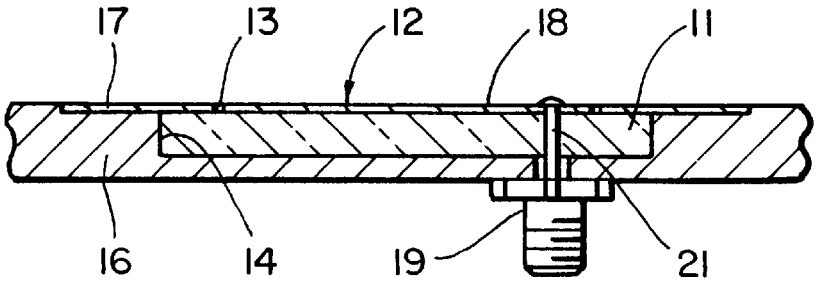
FIG 2 (PRIOR ART)
FIG. 2 is a sectional view of the antenna of FIG. 1 taken along the line 2—2 of FIG. 1.
Figure 3:
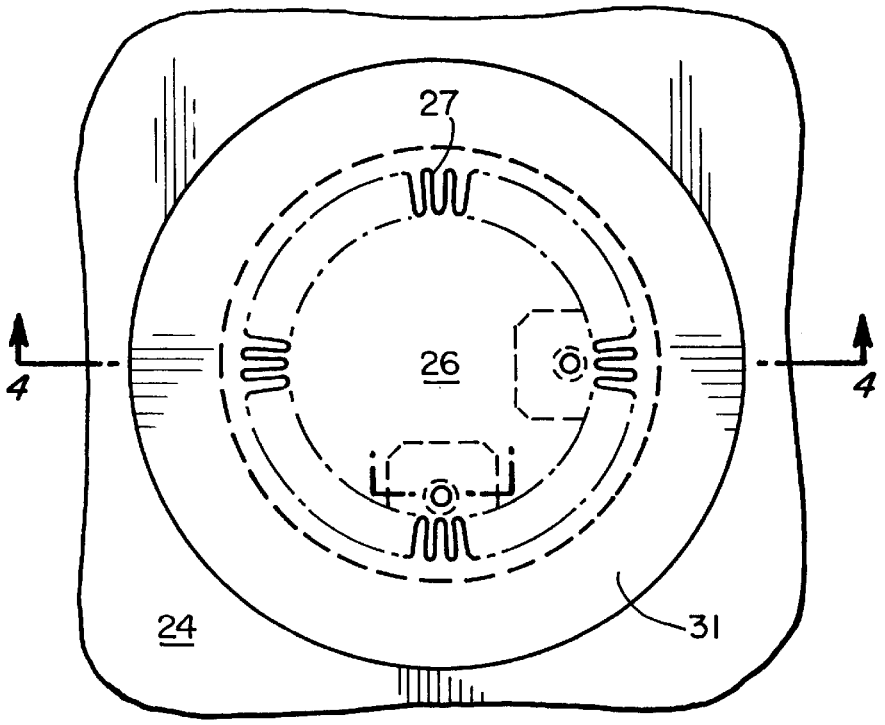
FIG. 3 is a plan view of a meander slot antenna in accordance with the preferred embodiment of the present invention.
Figure 4:
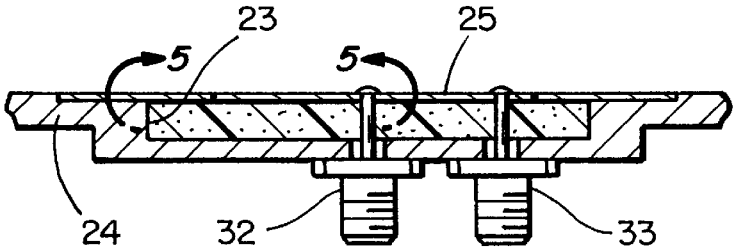
FIG. 4 is a sectional view of the antenna of FIG. 3 taken along the line 4—4 of FIG. 3.
Figure 5:
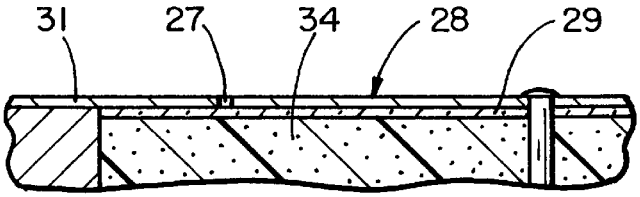
FIG. 5 is an enlarged view taken along the line 5—5 of FIG. 4.
Figure 6A:
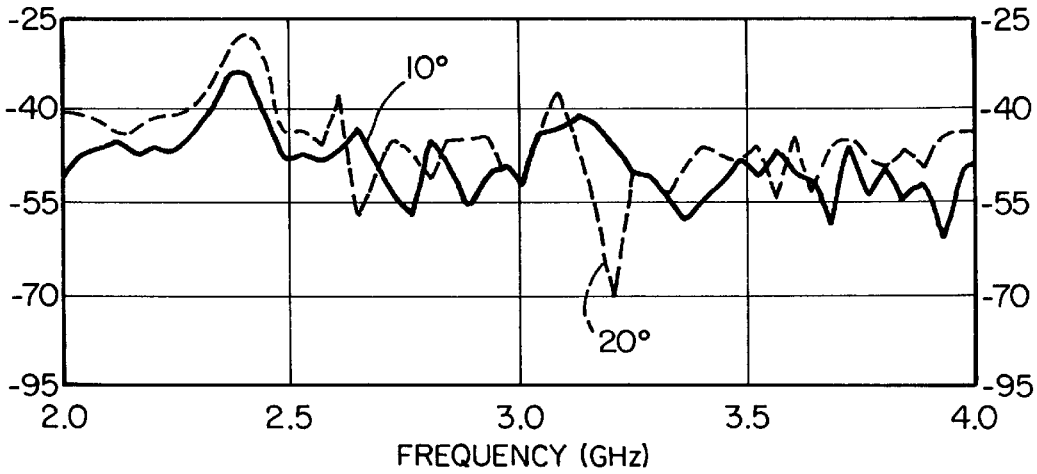
FIGS. 6A–D show typical radar cross section data for an antenna constructed in accordance with FIGS. 3–5.
Figure 6B:
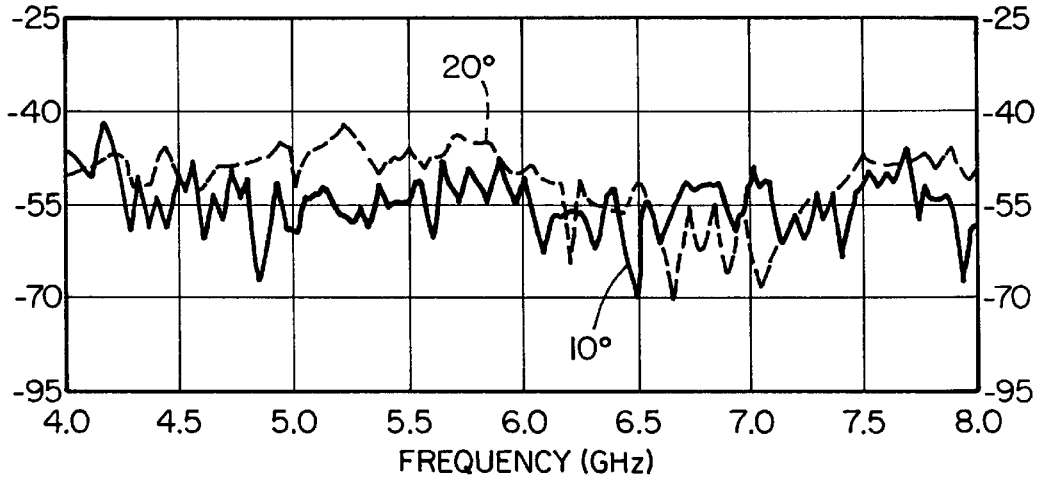
Figure 6C:
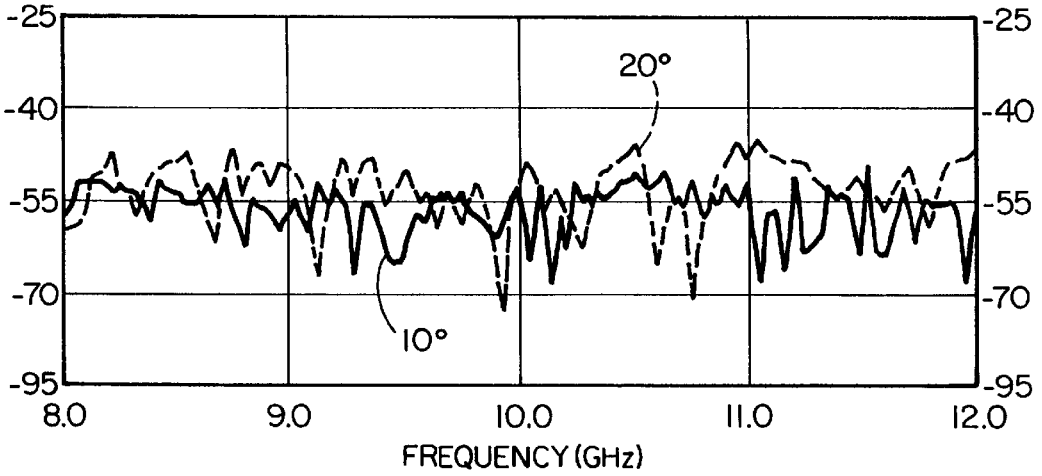
Figure 6D:
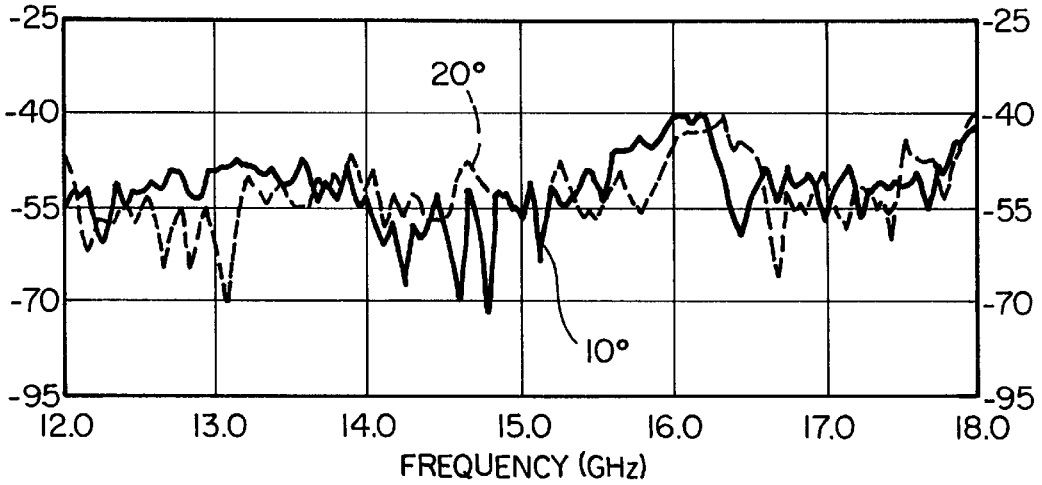

Referring to FIGS. 3–5 a slot antenna including increased capacitance per unit length of the radiating portion of the patch is shown. The antenna is formed over a cavity 23 formed in a conductive structure 24 which serves as the ground plane. The patch antenna 26 is defined by etching a meander slot 27 in the conductive film 28, such as copper, carried by a thin dielectric substrate 29. The capacitance is increased per unit length of the slot in a direction perpendicular to the E fields. The outer or surrounding film 31 is connected to the ground plane or structure whereby when voltages are applied to the film via the coaxial connectors 32 and 33, electric fields are set up across the slot and radiate electromagnetic energy omnidirectionally. The cavity is preferably filled with a foam material 34. In one example the slot was 0.0075 inches wide, with a meander length of 0.12 inches, and a meander repetition rate of 28.65 per radian, formed in a copper film 0.001 inches thick, carried by a dielectric substrate 0.010 inches thick. The copper and dielectric laminate substrate can be purchased from Rogers Corporation. It is of course apparent that any laminated substrate having a conductive upper surface can be used to form the patch antenna. It is noted that by adding length in the direction parallel to the E fields of the slot makes a capacitance that is no longer a perfect lumped element. However, it has been found that a meander slot with a radial dimension of approximately 0.2 inches has good backscatter suppression at frequencies as high 18 GHz. The use of the backup foam in the main body of the cavity reduces the antenna's susceptibility to variations in dielectric constant. An antenna was constructed and placed over a cavity 1.750 inches in diameter with the a radial slot variation of approximately 0.210 inches. The radar cross-sectional data for the antenna shown in FIGS. 3–5 is shown in FIGS. 6A–6D over the frequency range from 2–18 GHz. The solid line curve is for an elevation of 10° while the dotted line curve is for an elevation of 20°. Thus, it is seen that the antenna has a very low radar cross section throughout the frequency range.

Figure 7:
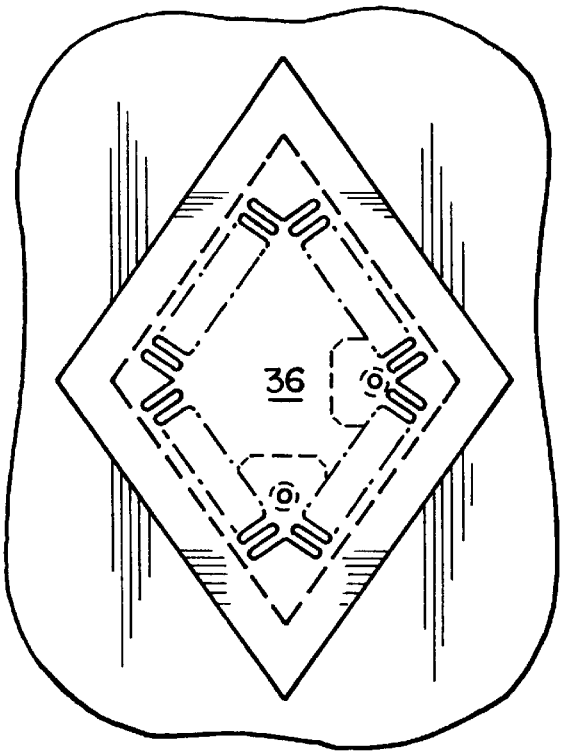
FIG. 7 is a plan view of a rhombic patch antenna with a meander slot.
Figure 8:
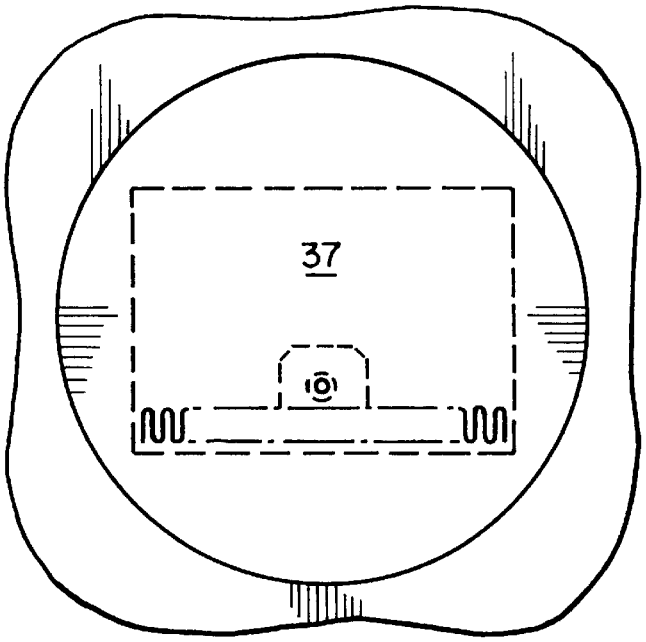
FIG. 8 is a plan view of a single meander slot cavity-backed antenna.

While the antenna described was implemented in a circular patch structure, it is clear that the present invention is applicable to any narrow band, cavity backed antenna. For example, the rhombic patch 36 of FIG. 7 might be used when the maximum allowable radar cross section is lower in some azimuthal direction than others. FIG. 8 shows a single linear slot 37 cavity backed antenna. The slot of FIG. 8 could be combined with a second (not necessarily orthogonal) slot to form a cross-slot. Although not shown an antenna can be constructed with a circular patch structure of the type described concentric within a second larger circular patch structure, thereby creating a dual band antenna.

Figure 9:
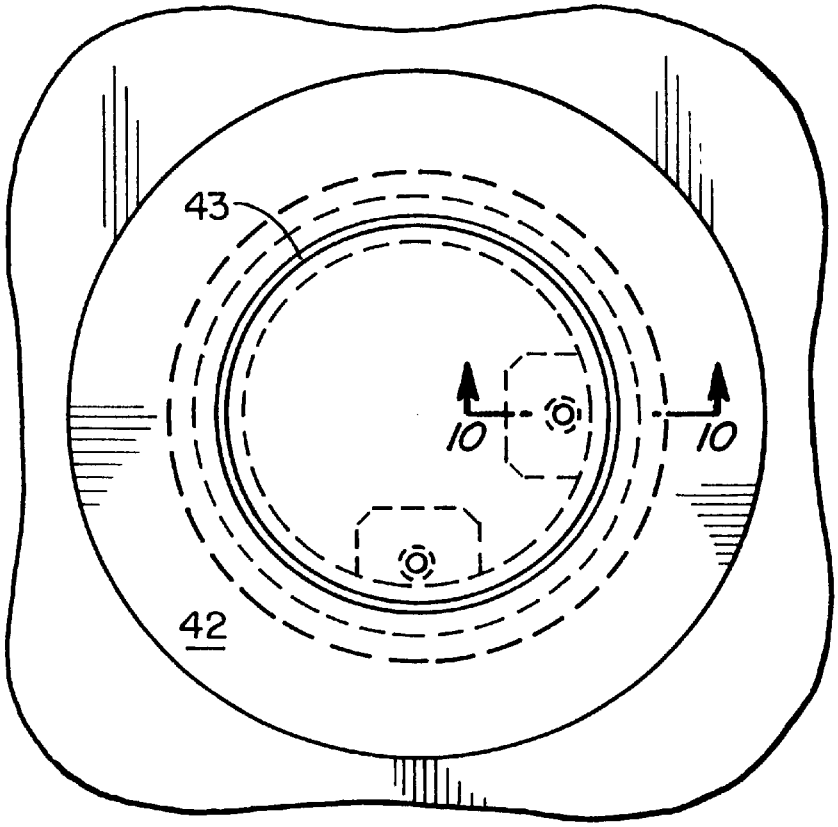
FIG. 9 is a plan view of another cavity-backed slot antenna having increased capacitance area per unit length of the slot.
Figure 10:
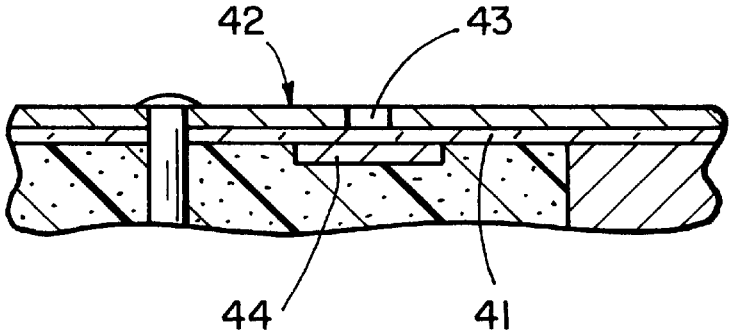
FIG. 10 is an enlarged view of section 10—10 of FIG. 9.
Figure 11:
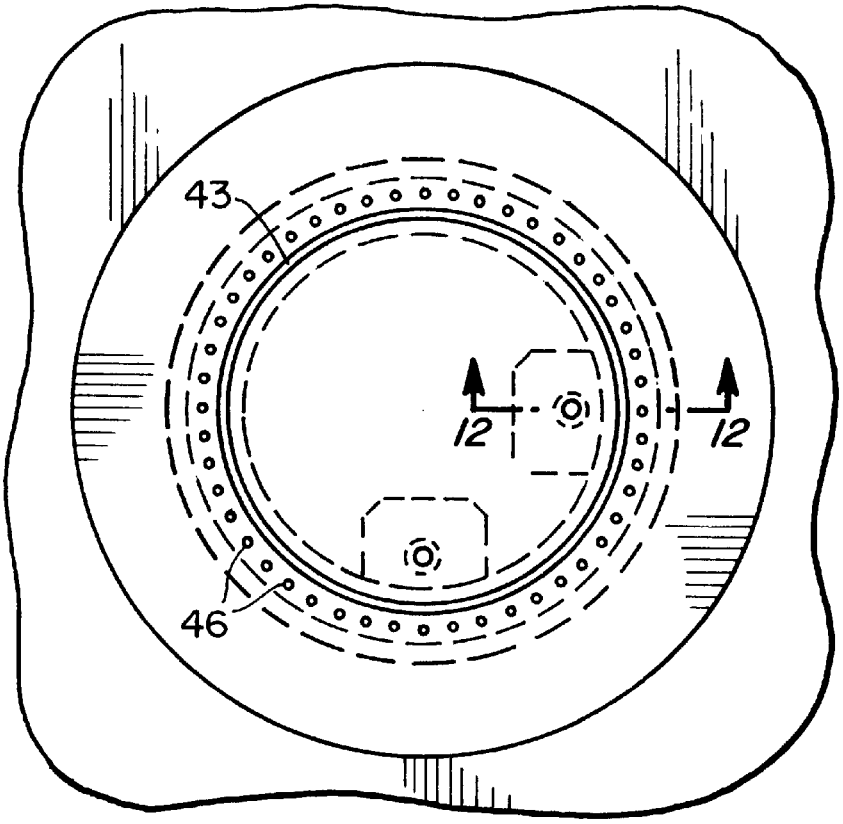
FIG. 11 is a plan view of still another cavity-backed slot antenna having increased capacitance area per unit length of the slot.
Figure 12:
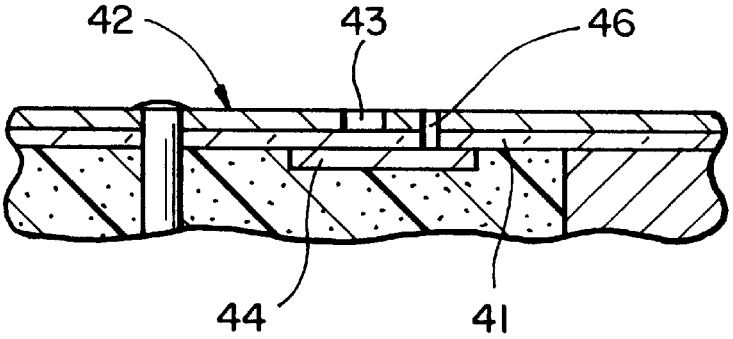
FIG. 12 is an enlarged view of the section 12—12 of FIG. 11.

A second means of obtaining the increased capacitance per unit length of the patch is shown in FIGS. 9 and 10. A substrate 41 having a conductive film or layer 42 on each surface is etched on the upper surface to form a linear slot 43. The lower surface is etched to leave a ring 44 opposite the slot 43. This creates a parallel plate structure with an increased value of capacitance per unit length of the patch by forming capacitance on both sides of the slot. The effective capacitance may be further increased in another embodiment when the ring 44 is physically connected to one side of the slot by plated through-holes 46 as shown in FIGS. 11 and 12.

Figure 13:
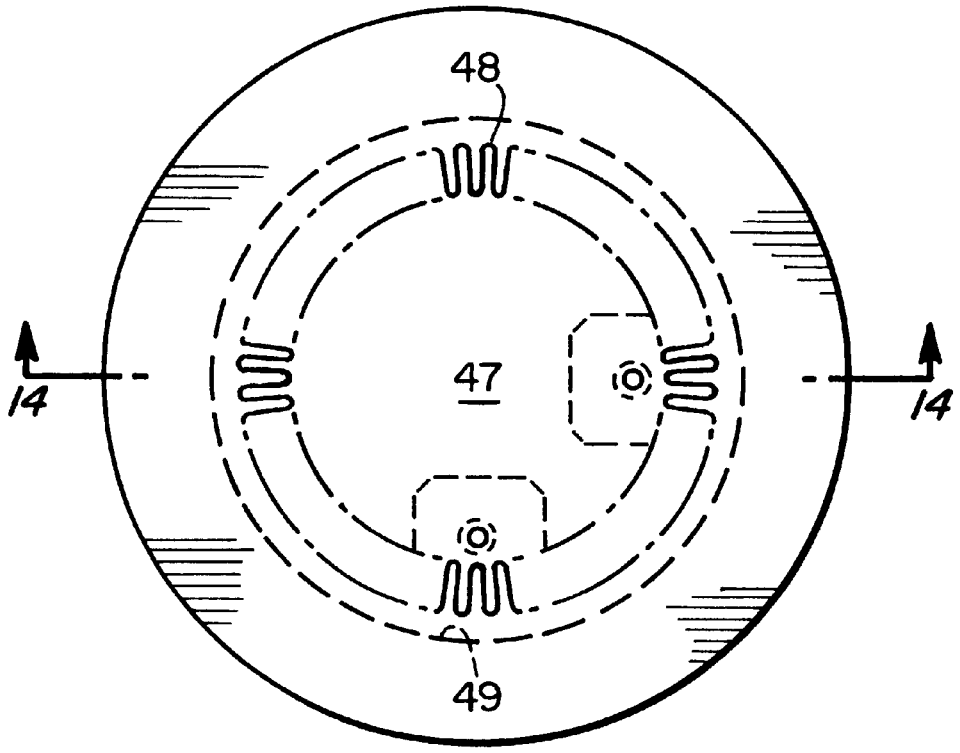
FIG. 13 is a plan view of a surface mount slot antenna in accordance with the invention.
Figure 14:
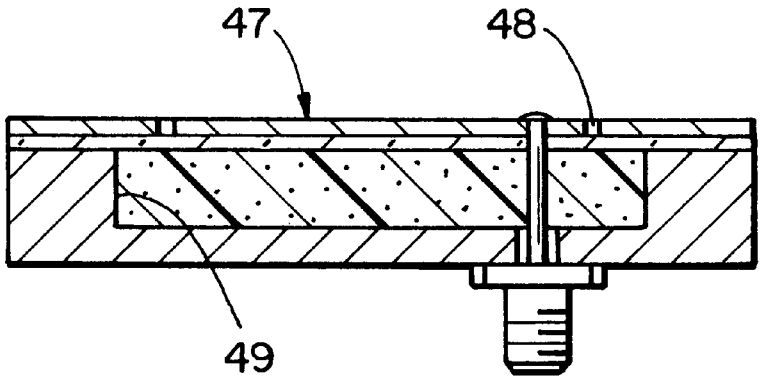
FIG. 14 is a sectional view taken along the line 14—14 of FIG. 13.

Although the antenna has been described with respect to cavities formed in a conductive support structure or ground plane, the antenna may be constructed so as to be surface mounted. Referring particularly to FIGS. 13 and 14 a circular patch antenna 47 including a meander slot 48 is shown formed on a cup-shaped conductive cavity 49 which can be mounted on the surface of an airplane or the like.

Thus there has been provided a low radiation cross section antenna which is simple and inexpensive in construction.

What is claimed is:

1. An antenna for radiating electromagnetic energy comprising a conductive cavity, and a conductive film carried by a thin dielectric substrate above said cavity, said conductive film including one or more slots across which an electric field is applied to radiate said electromagnetic energy, characterized in that said one or more slots meander to increase the capacitance per unit length of said slot in a direction perpendicular to the electric field as compared to a simple straight slot.

2. An antenna as in claim 1 in which a foam material is disposed in said cavity to support said conductive film and dielectric substrate.

3. An antenna as in claim 1 including one slot which closes on itself to form an isolated conductive area whereby to form a patch antenna.

4. An antenna for radiating electromagnetic energy comprising a conductive cavity, and a conductive film carried by a thin dielectric substrate above said cavity, said conductive film including one or more slots across which an electric field is applied to radiate said electromagnetic energy, characterized in that a conductive strip is supported opposite and overlapping the slot to increase the capacitance per unit length of the slot.

5. An antenna as in claim 4 including means for electrically connecting said conductive strip to the conductive film on one side of the slot.

6. An antenna as in claims 4 or 5 in which the slot closes on itself to form an isolated conductive area thereby forming a slot antenna.

7. An antenna as in claim 4 in which the conductive strip is connected to the conductive film on either side of the slot.

8. An antenna for mounting on a conductive ground plane comprising a cavity formed by a recess in said ground plane, and a conductive film supported by a dielectric substrate overlying said cavity, said conductive film including one or more slots across which an electric field is applied to radiate electromagnetic fields, characterized in that the said one or more slots meander to increase the capacitance per unit length of said slot in a direction perpendicular to the electric field is increased as compared to that of a simple straight slot.

9. An antenna as in claim 8 including a single slot in which the path of the slot closes on itself, thereby forming a conductive patch for a microstrip patch antenna.

10. An antenna as in claim 8 in which one or more of said slots do not close on themselves, thereby forming a cavity backed slot antenna.

11. An antenna for mounting on a conductive ground plane comprising a cavity formed by a recess in said ground plane, and a conductive film supported by a dielectric substrate overlying said cavity, said conductive film including one or more slots across which an electric field is applied to radiate electromagnetic fields, and conductive strips are placed immediately opposite and overlapping said one or more slots to increase the capacitance per unit length of the slot.

12. An antenna as in claim 11 in which said conductive strip is conductively connected to the conductive film on either side of the associated slot.

13. An antenna as in claims 11 or 12 in which the slot closes on itself to form an isolated conductive area thereby forming a slot antenna.

14. A slot antenna comprising a cavity, a conductive film carried by a dielectric substrate overlying, said cavity, said conductive film including a first area and a second area spaced from said first area by a slot whereby electric fields applied across said slot radiate electromagnetic fields into the surrounds, and meandering the slot to increase the capacitance per unit length along the adjacent areas of said slot as compared to that of a simple straight slot.

15. A slot antenna comprising a cavity, a conductive film carried by a dielectric substrate overlying said cavity, said conductive film including a first area and a second area spaced from said first area by a slot whereby electric fields applied across said slot radiate electromagnetic fields into the surrounds, and positioning a conductive strip opposite and overlapping, said slot to increase the capacitance per unit length of the slot.

16. A slot antenna as in claim 15 in which the conductive strip is conductively connected to either said first or second area.

17. An antenna as in claim 14, 15 or 16 in which the slot closes on itself to form a conductive patch surrounded by a conductive area to form a patch antenna.

* * * * *